US009132358B2

(12) United States Patent
Huang et al.

(10) Patent No.: US 9,132,358 B2
(45) Date of Patent: Sep. 15, 2015

(54) CARD-INSERTION REMOTE-CONTROL TALKING DOLL

(71) Applicant: MACOR TOYS (SHENZHEN) CO., LTD., Shenzhen, Guangdong (CN)

(72) Inventors: Debao Huang, Guangdong (CN); Daoshen Huang, Guangdong (CN)

(73) Assignees: MACOR TOYS (SHENZHEN) CO., LTD., Shenzhen (CN); TAK MEI TOYS EYEBALL FTY. LTD., Shenzhen (CN)

( * ) Notice: Subject to any disclaimer, the term of this patent is extended or adjusted under 35 U.S.C. 154(b) by 258 days.

(21) Appl. No.: 13/980,055

(22) PCT Filed: Oct. 15, 2012

(86) PCT No.: PCT/CN2012/082981

§ 371 (c)(1),
(2) Date: Jul. 17, 2013

(87) PCT Pub. No.: WO2013/149461

PCT Pub. Date: Oct. 10, 2013

(65) Prior Publication Data

US 2014/0073219 A1 Mar. 13, 2014

(30) Foreign Application Priority Data

Apr. 1, 2012 (CN) ..... 2012 2 0135874 U

(51) Int. Cl.
*A63H 3/28* (2006.01)
*A63H 30/04* (2006.01)

(52) U.S. Cl.
CPC ..... *A63H 3/28* (2013.01); *A63H 30/04* (2013.01); *A63H 2200/00* (2013.01)

(58) Field of Classification Search
None
See application file for complete search history.

(56) References Cited

U.S. PATENT DOCUMENTS

| | | | | |
|---|---|---|---|---|
| 2001/0029147 | A1* | 10/2001 | Hornsby et al. | 446/356 |
| 2002/0049021 | A1* | 4/2002 | Hornsby et al. | 446/289 |
| 2002/0123297 | A1* | 9/2002 | Hornsby et al. | 446/484 |
| 2002/0177383 | A1* | 11/2002 | Hornsby et al. | 446/175 |
| 2007/0093173 | A1* | 4/2007 | Zheng | 446/268 |

* cited by examiner

*Primary Examiner* — Jay Liddle
*Assistant Examiner* — Alex F.R.P. Rada, II

(57) ABSTRACT

A card-insertion remote-control talking doll is disclosed, which includes a shell, eyes capable of winking and driving motors thereof, and further includes: a speaker, a remote control and a driving control circuit disposed inside the shell; wherein a card slot for inserting a card is disposed on a remote control shell, a plurality of keys of an input keyboard is disposed below the card slot; and push button bulges opposite the positions of the plurality of keys are disposed on at least one side of each card. The doll has the functions of voice interaction and learning.

9 Claims, 3 Drawing Sheets

CARD-INSERTION REMOTE-CONTROL TALKING DOLL

BACKGROUND OF THE INVENTION

1. Field of the Invention

The present application relates to a card-insertion remote-control talking doll.

2. Related Arts

Most of the existing dolls have simple functions, and lack interactions with children as well as a learning function.

SUMMARY OF THE INVENTION

The technical problem to be solved by the present application is to provide a card-insertion remote-control talking doll having a learning function.

The technical problem of the present application is solved through the following technical solution.

A card-insertion remote-control winking doll includes a shell, eyes capable of winking, and driving motors thereof, and further includes: a speaker, a remote control and a driving control circuit disposed inside the shell.

The remote control includes a remote control shell, a first processor, an input keyboard and an infrared emission circuit connected to the first processor, respectively, and the first processor is used for controlling the infrared emission circuit to emit an infrared signal according to an input of the input keyboard.

The driving control circuit includes a second processor, an infrared receiver and a motor control circuit connected to the second processor, respectively, the second processor is further connected to the speaker, the motor control circuit is connected to the driving motor; the infrared receiver receives the infrared signal emitted by the infrared emission circuit and transfers the infrared signal to the second processor, the second processor controls the speaker to play predetermined audio according to the infrared signal transferred by the infrared receiver; the second processor is further connected to the motor control circuit, and controls the motor control circuit to drive the driving motor according to the infrared signal transferred by the infrared receiver.

The remote control further includes a plurality of cards; a card slot for inserting a card is disposed on the remote control shell, a plurality of keys of the input keyboard is disposed below the card slot; and push button bulges opposite the positions of the plurality of keys are disposed on at least one side of each card.

Preferably:

A first positioning mechanism for limiting an insertion direction of a card is disposed on the card slot, and a second positioning mechanism fitting the first positioning mechanism is disposed on the card.

The first positioning mechanism is a positioning groove formed concave at a sidewall of the card slot, and the second positioning mechanism is a horizontal protrusion disposed on the card and fitting the positioning groove.

Gaps are disposed between adjacent keys on the input keyboard, the width of the gap is greater than the width of the push button bulge, the distance from any key to the left end of the card slot equals the distance from one of the gaps to the right end of the card slot; the push button bulges include a first push button bulge and a second push button bulge, and the first push button bulge and the second push button bulge are symmetrical about the midline of the side of a card where the first and second push button bulges are located.

The driving control circuit includes a trigger switch, the second processor includes a trigger terminal and a receiver power supply control terminal for controlling on and off of the power supply of the infrared receiver, the trigger switch is connected between the trigger terminal and the grounding; and the second processor is used for turning on the power supply of the infrared receiver when the trigger switch is closed, and turning off the power supply of the infrared receiver after delaying a predetermined time.

The second processor includes a motor control circuit driving end, the motor control circuit includes a fourth bipolar transistor, a fourth capacitor, and a fifth capacitor, the driving motors include a left-eye driving motor and a right-eye driving motor, the left-eye driving motor and the right-eye driving motor are connected in parallel and then connected in series between the power supply and the collector of the fourth bipolar transistor, the base of the fourth bipolar transistor is connected to the motor control circuit driving end, the emitter is grounded; and the fourth capacitor and the fifth capacitor are connected in parallel to the left-eye driving motor and the right-eye driving motor, respectively.

The remote control further includes a remote-control indicator lamp, and the remote-control indicator lamp is connected to the first processor.

The driving control circuit further includes a power supply indicator lamp, and the power supply indicator lamp is connected to the second processor.

Compared with the prior art, the doll of the present application increases the interactions with a user and has the function of language teaching. In preferred solutions, the design of two push button bulges ensures that one same key is triggered even when a card is inserted in different directions.

BRIEF DESCRIPTION OF THE DRAWINGS

The present application will become more fully understood from the detailed description given herein below for illustration only, and thus are not limitative of the present invention, and wherein.

DETAILED DESCRIPTION OF THE INVENTION

The present application is described in further detail below with reference to embodiments and the accompanying drawings.

Figure 1:
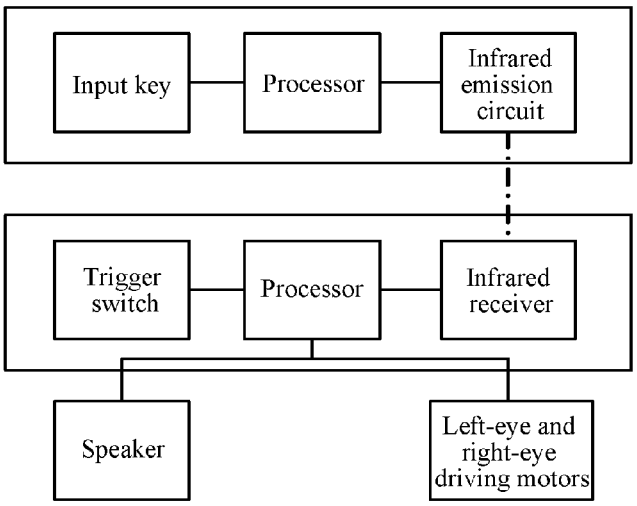
FIG. 1 is a circuit block diagram of a remote-control winking doll according to a specific embodiment of the present invention.

As shown in FIG. 1, a card-insertion remote-control talking doll in this embodiment is mainly formed of a shell, eyes capable of winking and driving motors thereof, a speaker, a remote control, and a driving control circuit disposed inside the shell.

Figure 2:
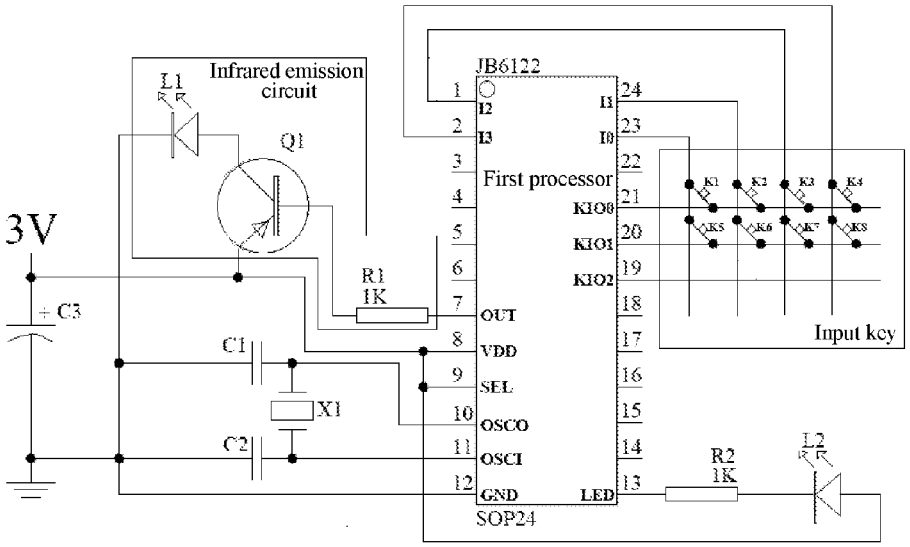
FIG. 2 is a circuit diagram of a remote control according to a specific embodiment of the present invention.

As shown in FIG. 2, the remote control is mainly formed of a remote control shell, eight cards, an input keyboard, a processor JB6122, an infrared emission circuit, a remote-control indicator lamp, an oscillation circuit, and a 3V direct-current power supply. The processor JB6122 is connected to the input keyboard and the infrared emission circuit and is used for controlling the infrared emission circuit to emit an infrared signal according to an input of the input keyboard. The 3V direct-current power supply is connected between a power supply terminal VDD of the processor JB6122 and the grounding. The input keyboard in this embodiment comprises eight input keys K1 to K8, the keyboard is connected to seven trigger terminals 1, 2, 19, 20, 21, 22, and 24 of the processor JB6122, each key triggers two of the trigger terminals to implement different input of different keys. The infrared emission circuit is formed of an infrared light-emitting diode L1, a bipolar transistor Q1, and a current-limiting resistor R1, the base of the bipolar transistor Q1 is connected to a first terminal of the resistor R1, the emitter thereof is connected to the direct-current power supply, the collector thereof is connected to the anode of the infrared light-emitting diode L1, a second terminal of the resistor R1 is connected to a signal output terminal OUT of the processor JB6122, the cathode of the infrared light-emitting diode L1 is grounded; the oscillation circuit is connected between the oscillation output terminal OSCO of the processor JB6122 and the oscillation input terminal OSCI; the anode of the remote-control indicator lamp L2 is connected to the SEL terminal and the direct-current power supply of the processor JB6122, and the cathode thereof is connected to the processor JB6122 through the current-limiting resistor R2.

Figure 3:
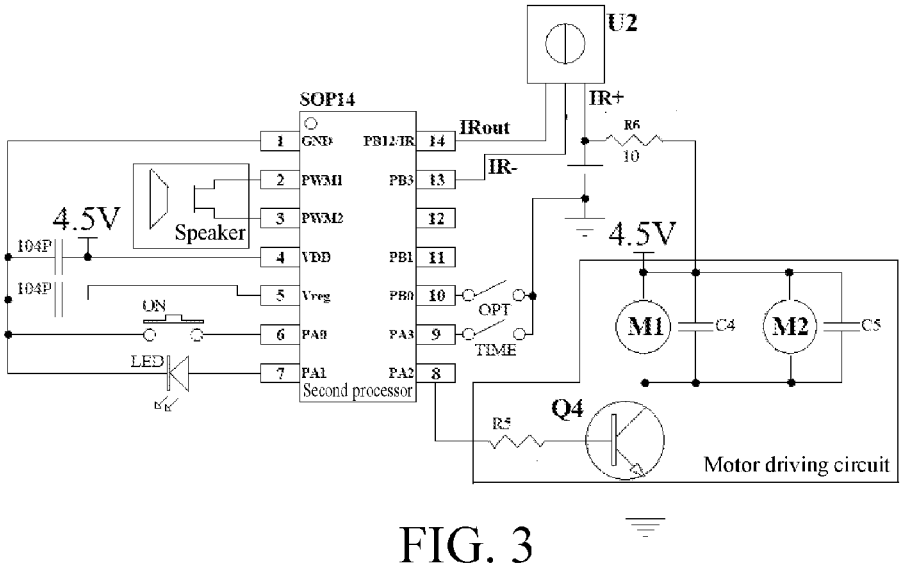
FIG. 3 is a circuit diagram of a driving control circuit according to a specific embodiment of the present invention.

As shown in FIG. 3, the driving control circuit is connected to left-eye and right-eye driving motors and is mainly formed of a processor SOP14, an infrared receiver U2, a motor control circuit, a trigger switch ON, a power supply indicator lamp, and a 4.5V direct-current power supply. The infrared receiver U2 is used for receiving an infrared signal sent by an infrared light-emitting diode and transferring the infrared signal to the processor SOP14, the signal output terminal IRout thereof is connected to the signal receiving terminal PB12/IR of the processor, the positive power supply terminal IR+ thereof is connected to the 4.5V direct-current power supply through the current-limiting resistor R6, the negative power supply terminal IR− thereof is connected to the PB3 terminal of the processor SOP14, the PB3 terminal is used as a receiver power supply control terminal for controlling on and off of the power supply of the infrared receiver U2, which controls on and off of the infrared receiver power supply by outputting high and low levels. The motor control circuit includes a fourth bipolar transistor Q4, a fourth capacitor C4, and a fifth capacitor C5. The driving motors include a left-eye driving motor M1 and a right-eye driving motor M2. The left-eye driving motor M1 and the right-eye driving motor M2 are connected in parallel and then connected in series between the 4.5V direct-current power supply and the collector of the fourth bipolar transistor Q4, the base of the fourth bipolar transistor Q4 is connected to the PA2 terminal of the processor SOP14, and the emitter is grounded. The PA2 terminal is a motor control circuit driving end, which controls the motor control circuit to drive the working of the left-eye and right-eye motors by outputting high and low levels. The fourth capacitor C4 and the fifth capacitor C5 are connected in parallel to the left-eye driving motor M1 and the right-eye driving motor M2, respectively. The trigger switch ON is connected between the trigger terminal PAO of the processor SOP14 and the grounding, the processor turns on the power supply of the infrared receiver U2 through the receiver power supply control terminal when the trigger switch ON is closed, and turns off the power supply of the infrared receiver U2 after delaying a predetermined time. The power supply indicator lamp is connected between the PA1 terminal of the processor and the grounding, and is used for indicating whether the power supply of the processor is in a working state or not. The speaker is connected between the PWM1 terminal and the PWM2 terminal of the processor SOP14 and is used for playing predetermined audio under the control of the processor SOP14.

Figure 4:
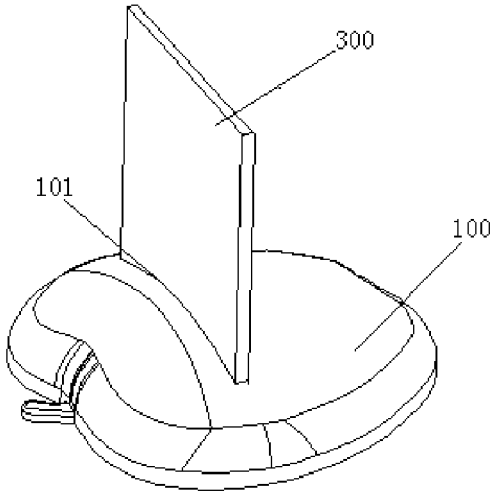
FIG. 4 is a schematic structural view of a remote control according to a specific embodiment of the present invention.

As shown in FIG. 4, a card slot for inserting a card 101 is disposed on a remote control shell 100 in this embodiment, and eight input keys 200 are arranged in a straight line below the card slot 101. The sizes of the eight cards 300 all fit the width of the card slot 101 to enable the cards 300 to be perfectly inserted in the card slot 101, a push button bulge 301 opposite the position of each of the eight keys 200 is disposed at the lower side of each of the eight cards 300 respectively, and each card 300 corresponds to one key 200. In practice, push button bulges may also be disposed on a plurality of sides or on every side of a card.

Figure 5:
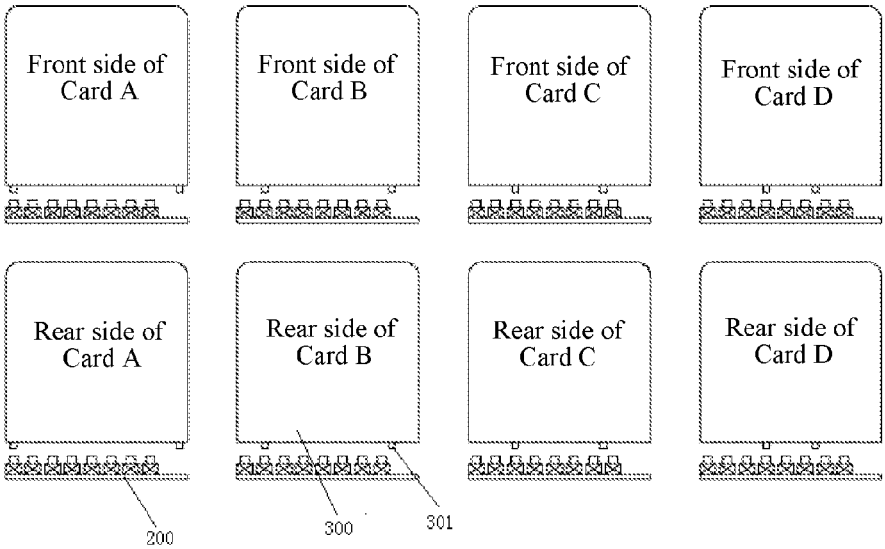
FIG. 5 is a principle view of the position arrangement of push button bulges for cards A to D according to a specific embodiment of the present invention.
Figure 6:
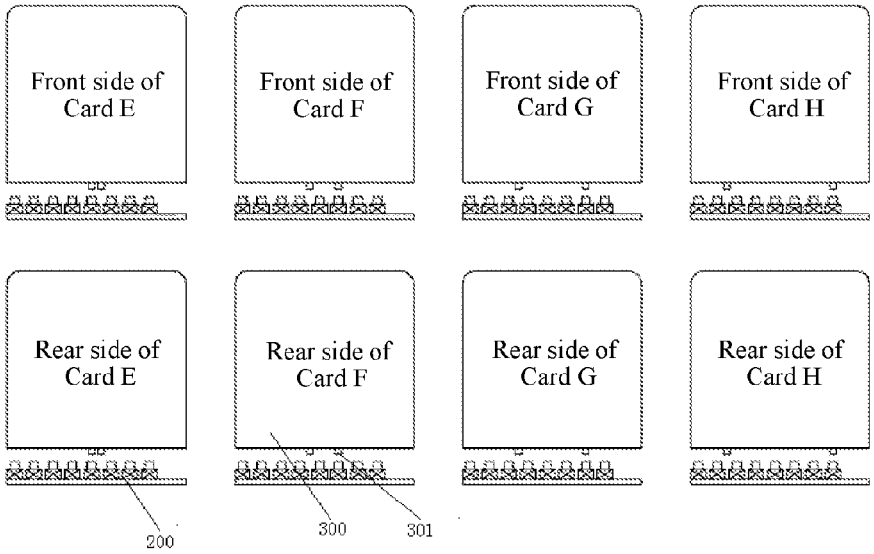
FIG. 6 is a principle view of the position arrangement of push button bulges for cards E to H according to a specific embodiment of the present invention.

As shown in FIG. 5 and FIG. 6, gaps are disposed between adjacent keys on the keyboard in this embodiment, and the width of the gap is greater than the width of the push button bulge, the distance from any key 200 to the left end of the card slot 101 equals the distance from one of the gaps to the right end of the card slot 101. Two push button bulges 301 are disposed at the lower side of each card 300, and two push button bulges 301 are symmetrical about the midline of the lower side of the card 300, so that the distance from the left push button bulge to the left side of the card equals the distance from the right push button bulge to the right side of the card. Based on the above arrangement, regardless of the direction in which the card 300 is inserted in the card slot 101, one of the two push button bulges 301 is always located at a corresponding key 200, and the other is located at a gap between two keys, so that always one same key is triggered.

A picture of, for example, a fruit, a vegetable or an animal is printed on every card in this embodiment, and the picture corresponds to the above audio.

The working principle of the remote-control winking doll in this embodiment is as follows.

First, a trigger switch on a doll is pulled to turn on the power supply of an infrared receiver to make the infrared receiver in a working state. Next, when a user inserts a card in a card slot, a corresponding key is triggered, and a processor JB6122 in the remote control controls an infrared emission circuit to emit a predetermined infrared signal according to an input of a key. After receiving the infrared signal, the infrared receiver transfers the infrared signal to a processor SOP14. The SOP14 controls the motor control circuit to drive a driving motor to enable an eye capable of winking to execute a winking action according to the received infrared signal, and at the same time controls a speaker to play corresponding audio, for example, when a user inserts a card printed with a picture of an apple, and controls the speaker to play the pronunciation of the word "apple" or the translation in another language of the word "apple" or the reading of sentences. A delay period is preset in the processor SOP14, and when a receiving head does not receive a signal for a predetermined delay, the power supply of the infrared receiver is turned off.

As an alternate solution, the following solution may be further adopted for the manner of fitting a card and a card slot in an embodiment. A first positioning mechanism for limiting an insertion direction of a card is disposed on a card slot, and a second positioning mechanism for fitting the first positioning mechanism is disposed on the card, and also only one push button bulge is disposed on the card. Through the fitting of two positioning mechanisms, it is limited that a card can only be inserted in one direction, thereby preventing one same card from triggering different keys. Various manners may be adopted for the first positioning mechanism and the second positioning mechanism. For example, the first positioning mechanism is a positioning groove formed concave at a sidewall of the card slot, and the second positioning mechanism is a horizontal protrusion fitting the positioning groove disposed on the card; or the first positioning mechanism is a positioning boss protruding from the sidewall of the card slot, and the second positioning mechanism is a groove fitting the positioning boss disposed on the card.

Although the present application is described above in further detail through specific embodiments, the present application is not limited to the specific embodiments. It should be understood by persons of ordinary skill in the art that any simple deduction or replacement made without departing from the spirit of the present application shall fall within the protection scope of the present invention.

What is claimed is:

1. A card-insertion remote-control talking doll system, comprising a shell, eyes capable of winking and driving motors thereof, and further comprising: a speaker, a remote control and a driving control circuit disposed inside the shell;

the remote control comprising a remote control shell, a first processor, an input keyboard and an infrared emission circuit connected to the first processor, respectively, the first processor being used for controlling the infrared emission circuit to emit an infrared signal according to an input of the input keyboard;

the driving control circuit comprising a second processor, an infrared receiver and a motor control circuit connected to the second processor, respectively, the second processor being further connected to the speaker, the motor control circuit being connected to the driving motor;

the infrared receiver receiving the infrared signal emitted by the infrared emission circuit and transferring the infrared signal to the second processor, the second processor controlling the speaker to play predetermined audio according to the infrared signal transferred by the infrared receiver; the second processor being further connected to the motor control circuit, and controlling the motor control circuit to drive the driving motor according to the infrared signal transferred by the infrared receiver;

wherein:

the remote control further comprises a plurality of cards; a card slot for inserting one of the plurality of cards is disposed on the remote control shell, a plurality of keys of the input keyboard is disposed below the card slot; and push button bulges opposite the positions of the plurality of keys are disposed on at least one side of each card.

2. The card-insertion remote-control talking doll system according to claim 1, wherein a first positioning mechanism for limiting an insertion direction of a card is disposed on the card slot, and a second positioning mechanism fitting the first positioning mechanism is disposed on a card.

3. The card-insertion remote-control talking doll system according to claim 2, wherein the first positioning mechanism is a positioning boss protruding from a sidewall of the card slot, and the second positioning mechanism is a groove fitting the positioning boss disposed on the card.

4. The card-insertion remote-control talking doll system according to claim 2, wherein the first positioning mechanism is a positioning groove formed concave at a sidewall of the card slot, and the second positioning mechanism is a horizontal protrusion fitting the positioning groove disposed on the card.

5. The card-insertion remote-control talking doll system according to claim 1, wherein gaps are disposed between adjacent keys of the input keyboard, the width of the gap is greater than the width of the push button bulge, the distance from any key to the left end of the card slot equals the distance from one of gaps to the right end of the card slot; the push button bulges comprise a first push button bulge and a second push button bulge, and the first push button bulge and the second push button bulge are symmetrical about the midline of the side of a card where the first and second push button bulges are at.

6. The card-insertion remote-control talking doll system according to claim 1, wherein the driving control circuit comprises a trigger switch, the second processor comprises a trigger terminal and a receiver power supply control terminal for controlling on and off of the power supply of the infrared receiver, the trigger switch is connected between the trigger terminal and the grounding; the second processor is used for turning on the power supply of the infrared receiver when the trigger switch is closed, and turning off the power supply of the infrared receiver after delaying a predetermined time.

7. The card-insertion remote-control talking doll system according to claim 1, wherein the second processor comprises a motor control circuit driving end, the motor control circuit comprises a fourth bipolar transistor, a fourth capacitor, and a fifth capacitor, the driving motors comprise a left-eye driving motor and a right-eye driving motor, the left-eye driving motor and the right-eye driving motor are connected in parallel and then connected in series between the power supply and the collector of the fourth bipolar transistor, the base of the fourth bipolar transistor is connected to the motor control circuit driving end, the emitter is grounded; and the fourth capacitor and the fifth capacitor are connected in parallel to the left-eye driving motor and the right-eye driving motor, respectively.

8. The card-insertion remote-control talking doll system according to claim 1, wherein the remote control further comprises a remote-control indicator lamp, the remote-control indicator lamp is connected to the first processor.

9. The card-insertion remote-control talking doll system according to claim 1, wherein the driving control circuit further comprises a power supply indicator lamp, and the power supply indicator lamp is connected to the second processor.

* * * * *